US006007424A

United States Patent [19]

Evers et al.

[11] Patent Number: 6,007,424

[45] Date of Patent: Dec. 28, 1999

[54] PAI GOW POKER GAME METHOD, DEVICE AND SYSTEM FOR PUSHES

[75] Inventors: Bill Evers, Denver; Philip Maiorka; Karen Smith, both of Monument, all of Colo.

[73] Assignee: Clover Gaming, LLC, Denver, Colo.

[21] Appl. No.: 08/858,553

[22] Filed: May 19, 1997

[51] Int. Cl.[6] ..... A63F 9/22

[52] U.S. Cl. ..... 463/13; 273/292

[58] Field of Search ..... 463/13, 12, 10, 463/27, 26, 25, 16; 273/292, 274, 303

[56] References Cited

U.S. PATENT DOCUMENTS

| | | | |
|---|---|---|---|
| 4,380,334 | 4/1983 | Minkoff et al. . | |
| 4,760,527 | 7/1988 | Sidley . | |
| 5,224,706 | 7/1993 | Bridgeman et al. . | |
| 5,248,142 | 9/1993 | Breeding . | |
| 5,294,128 | 3/1994 | Marquez . | |
| 5,314,194 | 5/1994 | Wolf . | |
| 5,356,140 | 10/1994 | Dabrowski et al. . | |
| 5,531,440 | 7/1996 | Dabrowski et al. . | |
| 5,560,613 | 10/1996 | Nguyen . | |
| 5,580,061 | 12/1996 | Kong . | |
| 5,584,486 | 12/1996 | Franklin . | |
| 5,607,161 | 3/1997 | Skratulia | 273/292 |
| 5,810,354 | 10/1998 | Banyai | 273/292 |

*Primary Examiner*—Michael O'Neill

*Attorney, Agent, or Firm*—Philip J. Anderson; Quirk & Tratos

[57] ABSTRACT

A method, device and system are set forth for playing a new game of Pai Gow Poker. The method includes dealing seven cards to the dealer and each player, the players and dealer each from those seven cards assembling a five card high hand and a two card low hand. For the player to win their wager, both the player's high and low hands must outrank the dealer's hands according to the ranking of hands of Poker. For a push the player's high hand must have a higher ranking the dealer's and be Jacks or better. All other hands are losses. The method provides for greater payoffs if the player has one of a plurality of payoff qualifying holdings. The device includes a processor programmed to play the game according to the method. The system provides for linking devices to amass a progressive jackpot should the player obtain a qualifying holding.

26 Claims, 4 Drawing Sheets

PAI GOW POKER GAME METHOD, DEVICE AND SYSTEM FOR PUSHES

FIELD OF THE INVENTION

The present invention relates to methods and devices for playing live and electronic games using playing cards and to the play of Pai Gow Poker.

BACKGROUND OF THE INVENTION

Pai Gow Poker is a popular live table game played by one or more players against a dealer using a standard deck of 52 playing cards or a modified deck which includes a Joker. When a Joker is used it can represent an ace or can be wild to complete a straight or flush.

To play the game of Pai Gow Poker, each player makes a wager. The dealer then deals seven cards to each player and seven cards representing a dealer's hand. Each player arranges their seven cards into a five card high hand and a two card low hand. The five card high hand must outrank, according to the standard rankings of poker, the two card low hand. Once the players have arranged and exposed their high and low hands, the dealer exposes their cards and likewise arranges them into a five card high hand and a two card low hand according to the same rules of the player. Thereafter the hands are resolved to determine wins, losses and pushes.

For a player to win their wager, both of the players' high and low hands must outrank, according to the standard rules of ranking hands of poker, the corresponding high and low hands of the dealer. If the players' hands do outrank the dealer's, the player wins their wager and they are paid even money by the dealer. If the dealer's high and low hands outrank the players' corresponding high and low hands, that outcome is a loss for the player and their wager is collected. If the player's high hand outranks the dealer's high hand but the dealer's high hand outranks the player's low hand, that is considered a push and the player's wager is neither won or lost. Similarly, if the dealer's high hand outranks the player's high hand but the player's low hand outranks the dealer's low hand, that also is considered a push. In resolving the hands, where any player's hand ties a dealer's hand, the dealer's hand is presumed to outrank the player's. Thus, for example, if the player's high hand outranks the dealer's high hand but the low hands are ties, that is considered a push since the dealer's low hand is presumed to outrank the player's low hand.

After the hands are resolved and wagers paid or collected, new wagers are made and a new hand is dealt. Winning wagers are paid at even money.

A drawback of standard Pai Gow Poker of the type described above is that if a player wins their hand, they are only paid even money. Thus, in order to win more, a player must wager more. Larger payoffs or jackpots are not offered. A further drawback is that a large number of hands result in pushes. This results in a relatively slow game since many outcomes are not favorable or unfavorable to either the player or the dealer. Still a further drawback is that the game is relatively even with respect to odds of the dealer or the player winning the hand. Hence casinos providing Pai Gow Poker assess a commission on winning hands. There is, therefore, a need for a modified poker game which provides a number of opportunities for increased payoffs and which generally overcomes the problems and drawbacks with Pai Gow Poker noted above.

These drawbacks including the assessment of a commission and the even money payoffs for winning hands has prevented Pai Gow Poker from being considered for being incorporated into an electronic gaming device. There is, therefore, a need for an improved Pai Gow Poker game which overcomes these drawbacks and which facilitates the incorporation of Pai Gow Poker into an electronic gaming device.

SUMMARY OF THE INVENTION

There is, therefore, provided according to the present invention a method for playing an improved game of Pai Gow Poker which overcomes the drawbacks of conventional Pai Gow Poker, which provides opportunities to win amounts many times the initial wager and which facilitates incorporation of the improved game into an electronic gaming device.

The method for playing the improved game of Pai Gow Poker includes each player making a wager and the dealer dealing seven cards to the dealer and seven cards to each player. From their cards, the players assemble a five card high hand and a two card low hand, the high hand having a ranking, according to the ranking of hands of poker, higher than the low hand. After the players have completed assembling their hands, the dealer exposes his/her cards and, in a similar fashion and according to the same rules, assembles the dealer high and low hands. The player's hands are exposed and resolved in sequence to determine the outcome of each player's hands as a winning outcome, losing outcome or a push. For a winning outcome, the player's high and low hands must outrank, according to the rankings of poker, the corresponding dealer high and low hands. A push is declared if (i) the player's high hand outranks the corresponding dealer's high hand and (ii) has at least a predetermined qualifying ranking and the dealer's low hand outranks the player's low hand. All other outcomes are declared losing outcomes for the player. In determining the comparative rankings of hands, for tie hands, e.g. the player and the dealer have the same low hand ranking, the dealer's hand is deemed to outrank that of the player. The player may be paid even money or better for winning outcomes and the wager is forfeited for losing outcomes.

As a further feature, the method includes, should the outcome be (i) a player win and (ii) the player's high hand be of a predetermined qualifying holding, paying the player a higher amount according to a predetermined payout schedule.

In one aspect, the method may require for a push that the player's winning high hand be a pair of Jacks or better. In this fashion, the number of "pushes" can be reduced.

As a further aspect of the method according to the present invention, at least one pre-determined holding of the player's high hand is designated as a qualifying "bad beat" combination. If the player obtains the bad beat combination and loses the hand, the player is paid an amount according to a payout schedule.

Also according to the present invention, an electronic gaming device is set forth for playing the game of Pai Gow Poker, the device including a processor having a first data structure representing each card of a standard deck of 52 cards (or the fifty-two cards plus a Joker) and means for randomly selecting from the data structure seven dealer cards and seven player cards. The processor further includes a second data structure of qualifying card payoff combinations. A display is provided to display the selected dealer and player cards. Means are provided for accepting a wager representing an actual monetary wager or a fictitious wager and for initiating the play of the game, the initiation signaling the processor to select the dealer and player cards. The player selected cards are displayed. Means are provided for the player to select from the displayed player cards two cards for the player low hand and five cards for the player high hand, again the player's high hand should have a higher ranking according to the ranking of hands of poker than the low hand. Once the player has made their selection, the processor is programmed to arrange the selected dealer cards into the corresponding five card and two card hands according to the same rules as the player and to display those hands. The processor then compares the dealer and player hands to determine if the player has a winning, losing or push outcome determined by the rules set forth above according to the method of the present invention. For winning outcomes, the processor also compares the cards of the player's high hand to the qualifying combinations of the second data structure to determine if the player's high hand is a qualifying combination. The device also includes means for paying or crediting the player for winning outcomes and for paying or crediting the player greater amounts for qualifying combinations according to a pre-determined pay schedule. For losing outcomes the wager is forfeited. Where the player has a losing outcome and his/her hand matches a qualifying bad beat combination, the player is paid according to a pre-determined pay schedule.

The device, by incorporating the features of the improved Pai Gow Poker game, can be played without requiring the assessment of a commission on winning hands and further provides for payouts, according to a pre-determined payout schedule, for winning, qualifying combinations. Still further, the bad beat feature described above with reference to the method of the present invention can be incorporated into the gaming machine device.

Still further, the Pai Gow Poker gaming devices according to the present invention may be interlinked within a gaming facility or between gaming facilities and provide for allocation of a portion of each wager to one or more progressive jackpots to be awarded if a player obtains a jackpot qualifying outcome.

BRIEF DESCRIPTION OF THE DRAWINGS

These and other features and advantages of the present invention will become better appreciated with reference to the specification, claims and drawings wherein:

DESCRIPTION

Figure 1:
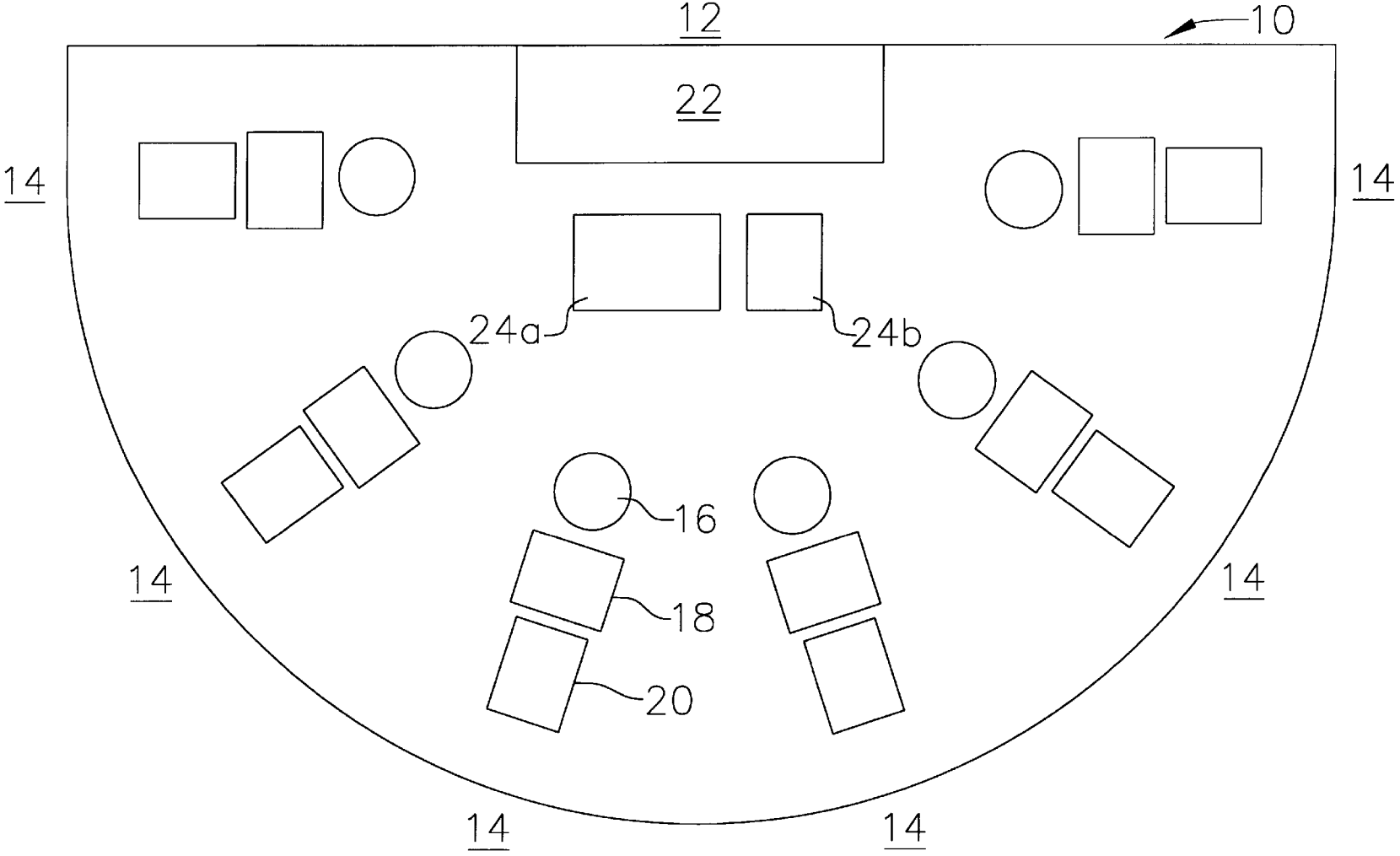
FIG. 1 is a plan view of a table layout for play of the table games version of the present invention.

Turning to the drawings, FIG. 1 illustrates a layout 10 for use in playing a Pai Gow Poker game according to the method of the present invention. While the layout 10 may have any suitable shape, preferably it is semi-circular and defines a tabletop to control the play of the game. The layout 10 provides at one side a dealer's position 12 to accommodate the dealer dealing the game on behalf of the casino and a plurality of player positions 14 to be occupied by players playing the game. At each player position 14 there is a designated wagering area 16 in which a player places their wager, a player low hand area 18 and a player high hand area 20 in which the player places the arranged hands in the manner described below.

At the dealer's station 12 is a check tray 22 to hold the chips or checks used in playing the game. To play the improved Pai Gow Poker game according to the present invention, each player places their wager in the wagering area 16 to participate. Table minimums and maximums may be applied to govern the amounts which a player can wager. Once each player has placed their wager in the appropriate area, the dealer deals seven cards to each player and seven cards to him/herself. It is to be noted that the game according to the present invention can be played with a standard deck of 52 playing cards or a deck of those same 52 playing cards plus a Joker. If a Joker is used, and in accordance with the traditional rules of Pai Gow Poker, the Joker is wild to represent aces and cards to complete a straight flush, flush or straight.

Once seven cards have been dealt to each player participating in the game and the dealer, the players pick-up their seven cards and arrange the cards into a five card high hand and a two card low hand. According to the known rules of Pai Gow Poker, the five card high hand must outrank, according to the ranking of hands of poker, the two card low hand. If a player misarranges their hand, that is considered a losing outcome for the player and their wager is collected. After the players have arranged their hands, they place their five card high hand face down in the high hand area 20 and their two card low hand face down in the low hand area 18. After all the players have arranged and located their hands, the dealer exposes his/her seven card hand and likewise arranges the cards into a five card high hand and a two card low hand. As with the players, the dealer's high hand must outrank, according to the ranking of hands under the rules of poker, the low hand. When arranged, the dealer places the two card low hand in a dealer low hand area 24*a* and the five card high hand in a dealer high hand area 24*b* on the layout 10 for the players to see. Thereafter each of the player's hands, in sequence from left to right, is exposed and resolved against the corresponding dealer's hands.

To resolve the hands, the dealer compares each of the player's hands to the dealer's corresponding hands. For a player to have a winning outcome, both of the players' high and low hands must outrank, again according to the rankings under the rules of poker, the dealer's high and low hands. If the player has a winning outcome and his hands outrank the dealer's hands, the player is paid at least even money on their wager. In resolving the hands and comparing the rankings, if the dealer's hand and the corresponding player's hand have the same ranking, the dealer's hand is deemed to outrank the player's hand. That is, all tie hands are resolved in favor of the dealer.

If the player's high hand outranks the dealer's high hand but the dealer's low hand outranks the player's low hand, and if the outranking player's high hand is of a predetermined qualifying holding, the hand is considered a push and is neither a winning or losing outcome for the player. In cases of a push, the player's wager is neither paid nor collected.

All other outcomes are considered a losing outcome for the player and the dealer collects their wager.

In regards to the "push" hands, to reduce the number of pushes which would ordinarily occur according to the rules of traditional Pai Gow Poker, the outranking player's high hand must have a predetermined qualified holding, preferably Jacks or better. While any other, pre-determined qualified holding may be used, Jacks or better is a convenient and easily recognized qualifying holding for the players. By defining a qualifying holding necessary for a player to obtain a push, the number of pushes are reduced by transforming what would normally have been pushes into losing outcomes. This increases the odds to the advantage of the dealer, house or casino thereby dispensing with the need for assessing a commission from players for winning outcomes.

To increase the opportunities for an increased payoff, the method according to the present invention includes selecting pre-determined combinations of cards for the player's high hand in winning outcomes to pay according to a pre-selected pay table. As but an example, should the player obtain a winning outcome, i.e., not a losing outcome or a push, pre-selected outcomes and payoffs can be as shown in Table 1.

TABLE 2

| | |
|---|---|
| Royal Flush | 800 to 1 |
| Straight Flush | 200 to 1 |
| Four of a Kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1 |
| Higher Ranking | 2 to 1 |

Thus, if a player obtains a winning outcome and their five card high hand is four of a kind, the player would be paid 20 to 1 for their wager. Accordingly, if a player is fortunate enough to have a winning outcome and a high hand of four of a kind, rather than simply winning even money on their wager, they can obtain a greater payoff.

Where the deck being dealt includes the Joker, the same rules of play described above apply and the payoff table for player winning outcomes is as shown in Table 2.

TABLE 2

| | |
|---|---|
| Five Aces | 800 to 1 |
| Royal Flush | 800 to 1 |
| Straight Flush | 200 to 1 |
| Four of a Kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1 |
| Higher Ranking | 2 to 1 |

As a further feature of the improved game according to the present invention, the method may include a "bad beat" feature. This feature of play rewards the player for obtaining a predetermined one of a group of qualifying ranking high hands but still losing the hand. For example, a player may be dealt cards so as to assemble a high hand of four of a kind and a low hand of Ace/King. The dealer may have a high hand of a straight flush and a low hand of a pair of fours thus resulting in a losing outcome for the player. To increase the excitement of the game and to attenuate the frustration which might be experienced by a player obtaining a favorable outcome and still losing the hand, the method according to the present invention may include paying the player for obtaining a bad beat combination if the player's high hand is of a pre-determined, qualifying combination. The combinations and payoffs may be as described in Table 3 where the game is played without a Joker.

TABLE 3

| | |
|---|---|
| Royal Flush | 400 to 1 |
| Straight Flush | 100 to 1 |
| Four of a Kind | 10 to 1 |

This bad beat feature may also be incorporated into the game dealt with the 52 card and Joker with the predetermined combinations and bad beat payoffs as set forth in Table 4 below.

TABLE 4

| | |
|---|---|
| Royal Flush | 400 to 1 |
| Straight Flush | 100 to 1 |
| Four of a Kind | 10 to 1 |

As can be appreciated, the Pai Gow Poker game according to the method of the present invention reduces the number of pushes increasing the odds in favor of the house, i.e. dealer and thereby dispenses with the need for exacting a commission on player winning outcomes. Furthermore by providing higher payoffs for certain high hand combinations, the game is more exciting in that a player may expect to receive a greater return than they have risked. Still further, by providing a bad beat feature, a player obtaining a qualifying combination and losing the hand may nonetheless receive a payoff. This, too, increases the excitement of the game.

Figure 2:
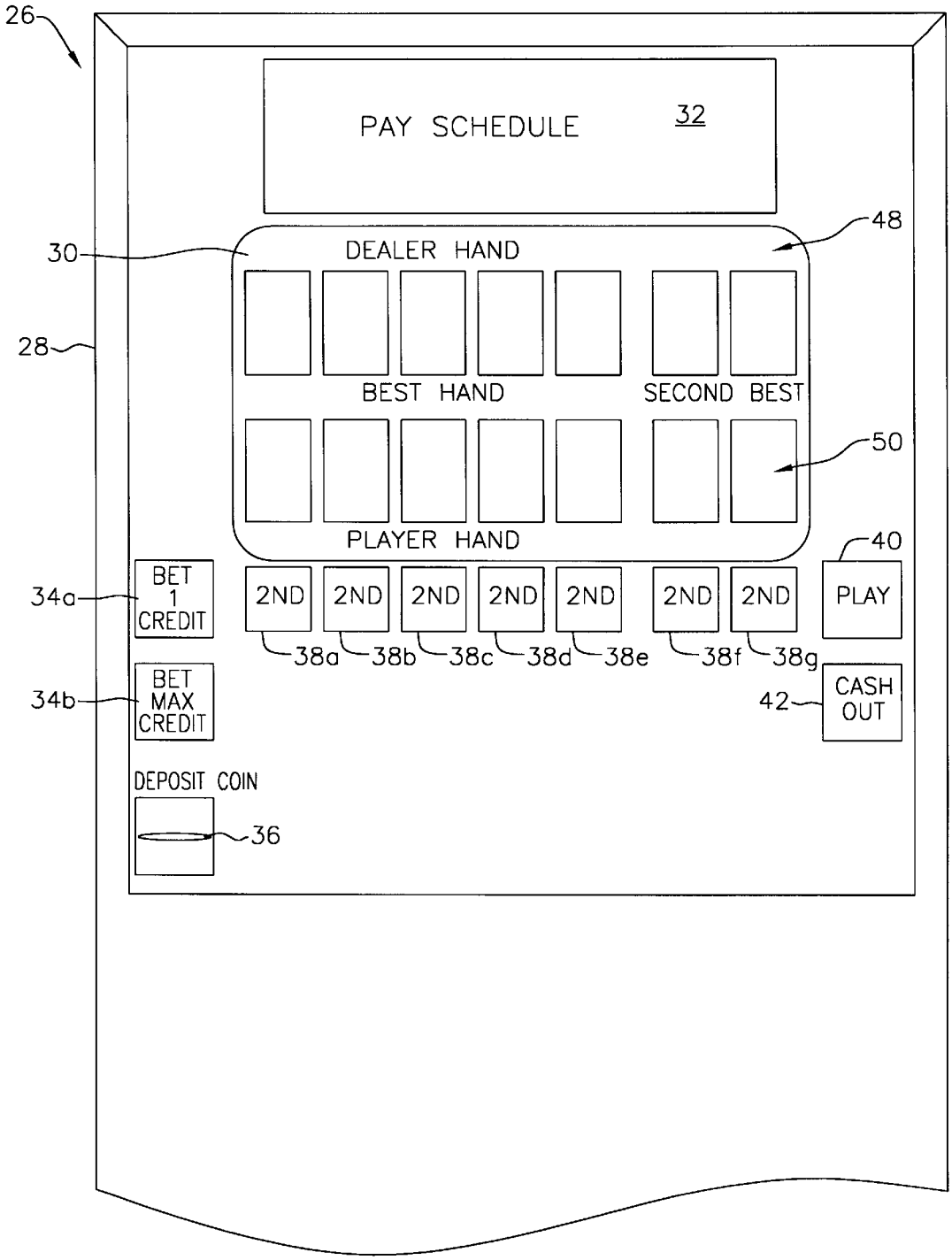
FIG. 2 illustrates a display of an electronic device for playing the game of the present invention.
Figure 3:
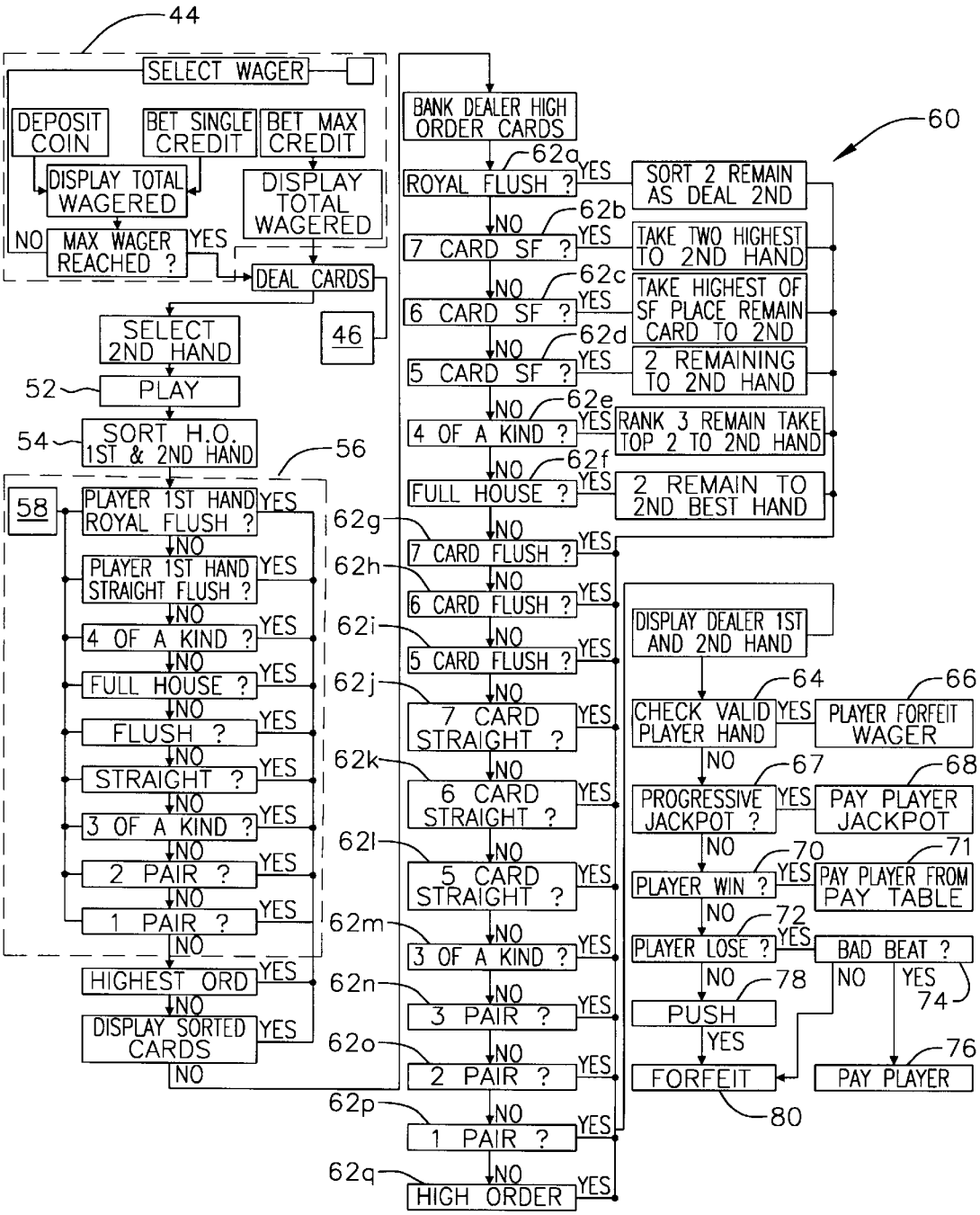
FIG. 3 is a logic schematic for the processor of the device of FIG. 2.
Figure 4:
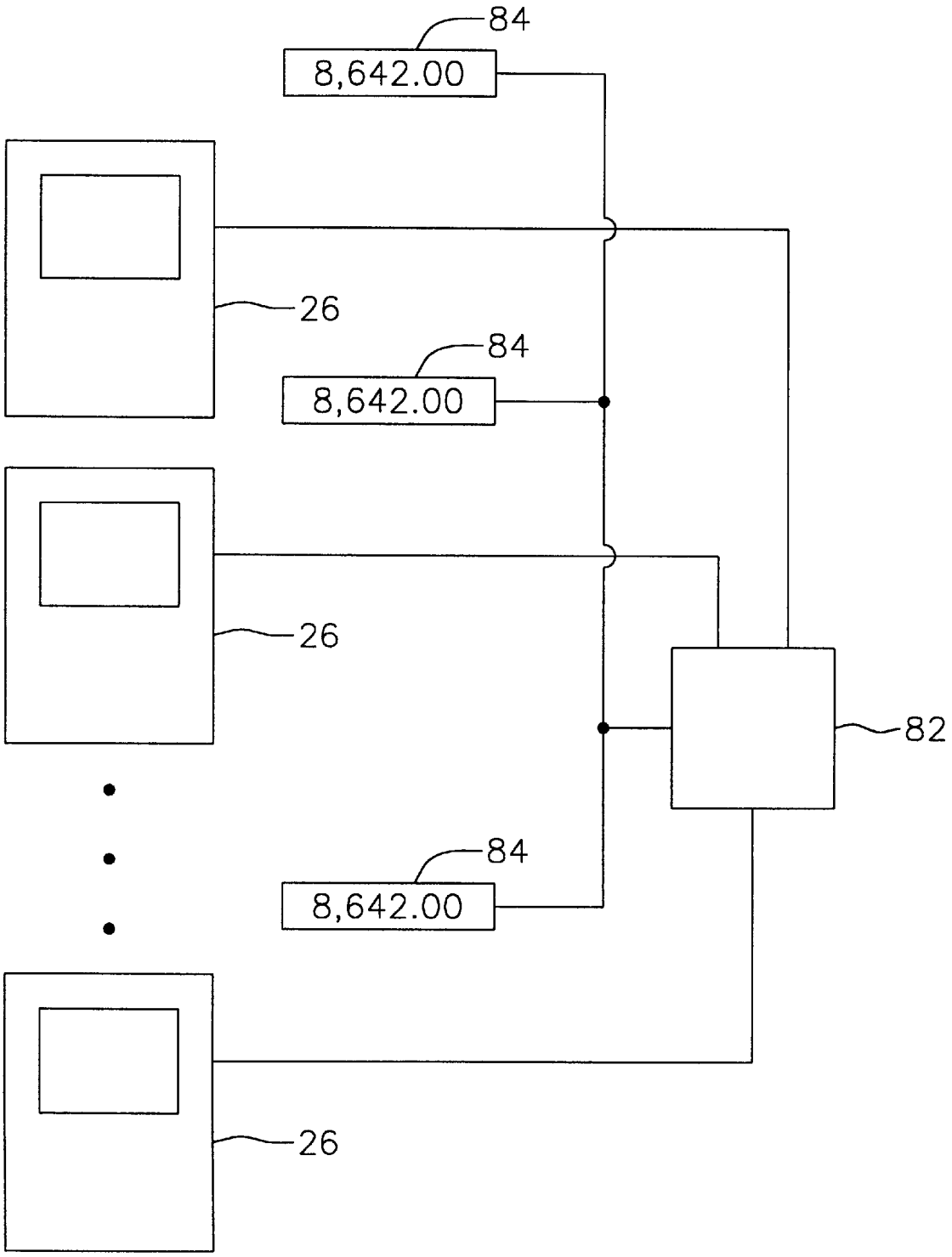
FIG. 4 is a schematic view illustrating a system including electronic gaming devices linked to provide a progressive jackpot.

With reference to FIGS. 2–4, a further aspect of the present invention is shown with the game incorporated as a feature into an electronic gaming device and system. Since there is no assessment of a commission on player wining hands as is done with Pai Gow Poker according to the prior art, the game may be incorporated into an electronic gaming device of the present invention.

With reference to FIG. 2, the device 26 includes a housing 28 of the type commonly used for electronic slot machines and video poker machines. The housing 26 has contained therein processing means for processing data as hereinafter described. Further the housing 28 includes a display 30 which may be a conventional video display terminal (VDT). Disclosed on the housing 28 above the display 30 is a pay table 32 listing the payoffs for certain outcomes of the game played according to the present invention. The pay table 32 may also, or alternatively, be displayed at the display 30.

Below the display 30 are numerous buttons and controls to control the play of the game as hereinafter described. To provide a means for accepting a wager there is provided two bet buttons 34*a,b*, respectively, by which a player may wager a single credit or the maximum amount permitted on the machine, e.g. five credits. For example, if the device 26 is a machine adapted to receive wagers in dollar increments, the player depressing the bet one credit bet button 34*a* would wager a single credit (one dollar) each time the button is depressed. If the player depresses the maximum bet button 34*b*, the maximum of, for example, five credits ( dollars) would be wagered. Below the bet buttons 34*a,b* is a coin slot 36 to receive wagers made by a player. Alternatively or additionally, as is well known, a cash validator ( not shown) may be incorporated into or used in conjunction with the device 26 to receive cash wagers to be applied as credits during play of the game.

Below the display are a plurality of selection buttons 38*a–g* by which the player, as described below, will control the play of the game according to the present method.

With continuing reference to FIG. 2, there is also provided on the housing 28 a play button 40 to initiate the play of the game and a cash out button 42 by which, in a known manner, the player may depress to cash out the credits accumulated during the play of the game. Not shown in FIG. 2 is a coin tray to receive the coins when cashing out.

Turning to FIG. 3, a logic schematic for the processor of the device 26 is shown. The processor may be of the type presently incorporated into machines such as video poker machines. The device 26 includes a means for accepting and determining the amount wagered. The wager may be a monetary wager, such as for example where the device 26 is used in a casino, or can be merely a fictitious wager such as where the game according to the present invention is played on a computer or handheld unit for entertainment purposes. These means for accepting a wager are shown generally as 44 and include a feature of accepting a deposited coin, such as having a coin inserted in coin slot 36 and for selecting maximum wager or a single token wager as described above. The display 30 includes a feature of displaying the total amount wager for the player to confirm the appropriate wager. The processor by known means detects and stores in memory the total amount wagered.

Once the wager has been made, means are provided to enable the player to initiate play. Play may be initiated by the player making the maximum wager whereupon the processor, detecting the maximum wager, automatically initiates play. If less than a maximum wager has been made, the player depresses play button 40 (FIG. 2) to initiate play. When play is initiated, the processor from a first data structure 46 randomly selects seven cards for each of a dealer's hand 48 and a player's hand 50. The first data structure 48 includes data representing each of the 52 cards of a standard deck or, where a modified deck is used, the 52 cards of a standard deck plus a Joker. The randomly selected cards for the dealer hand 48 are displayed on display 30 face down preferably segregating as five cards on the display for the dealer's high hand and two cards for the dealer's low hand. As shown in FIG. 2, the display 30 may include a designation identifying the dealer's hand as such and identifying the high hand as "best hand" and the low hand as "second best." The processor also randomly selects from the 52 cards of the first data structure seven other cards for the player's hand 50. As shown in FIG. 2, the player's hand 50 may be segregated into the five card "best hand" in the two card "second best" hand. The player's hand 50 is displayed with the cards face up for the players to see. The display 30 may have a designation identifying the player's hand for the player to differentiate between his hand 50 and the dealer's hand 48.

Once the player's hand 50 has been displayed on display 30, means are provided for the player to select the cards for the five card high hand and the two card low hand. As shown in FIG. 2, the selection may be by depressing two selected buttons of the selection buttons 38*a–g* to select the player's low hand. That is, the player viewing the seven displayed cards of the player's hand 50 would select the two cards for the player's low hand and depress the selection buttons 38*a–g* directly below and associated with the two selected cards. The display 30 may display suitable marker above the selected cards to confirm that the selection has been made. Once the player is satisfied that they have selected the appropriate two cards for the low hand or "second best" hand as identified on the display 30, the player depresses the play button 40 signaling the processor as indicated at 52 on FIG. 3 to rearrange the cards in the highest order in the player's high hand, or "best hand" and the player's selected two cards as the low hand or "second best" hand. The rearranging of the player's cards in highest order according to the rules of ranking of poker is shown at logic sequence 54 of FIG. 3. The cards of the player's hands are arranged in order, left to right in each of the respective high and low hands.

With reference to FIG. 3, once the player has arranged their hand, the processor with a comparison subroutine 56 compares the player's five card high hand to predetermined qualifying payoff combinations stored in a second data structure 58. Preferably the second data structure 58 includes data representing, for a 52 card deck game, the payoff combinations listed in Table 1 above or for a 52 card plus Joker game, the payoff combinations shown in Table 2 above. If the qualifying payoff combination permits, the combination is displayed at display 30 in order of right to left, e.g. for three of a kind, the three like cards would be displayed at the three left positions of the player's high hand.

Once the player's hand has been arranged, ranked and compared as described above, the processor automatically does the same with the dealer's hand according to a pre-programmed sequence shown generally at 60. According to this sequence, the processor at 62 ranks the dealer cards in highest order and sorts the seven cards to determine the various combinations that can be assembled from the seven cards of the dealer's hand 48. The dealer's hand sequence 60 tests the seven cards at 62*a* to determine whether or not a Royal Flush can be assembled and if so the processor assembles the five card Royal Flush as the dealer's high hand and allocates the remaining two cards to the dealer's low hand. As illustrated, if a Royal Flush cannot be assembled, the cards of the dealer's hand 48 are tested to determine whether or not a seven card Straight Flush exists as at 62*b* and if so, the processor assembles the two highest cards of the Straight Flush as the dealer's low hand or second best hand with the remaining five cards as the dealer's high hand. If a seven card Straight Flush does not exist, the processor at 62*c* tests to see whether a six card Straight Flush exists. If from the seven cards, a six card Straight Flush exists, the five lowest cards of the Straight Flush are assigned to the best hand with the highest card of the Straight Flush and the remaining seventh card allocated to the dealer's low hand. This sequence of testing the dealer's seven cards for formation of the high and low hand continues as illustrated in FIG. 3 with the dealer's hand sequence 60 shown at 62*d–q* to test the dealer's seven card hand to assemble the high and low hands. With reference to Table 5 below, the processor assembles the dealer's high and low hands accordingly.

TABLE 5

| 7- card holding | High hand | Low hand |
|---|---|---|
| Royal Flush + 2 cards | Royal Flush | 2 cards |
| 7 card SF | 5 lowest cards | 2 highest cards |
| 6 card SF + one card | 5 lowest SF cards | highest SF card + one card |
| 5 card SF + 2 cards | 5 SF cards | 2 other cards |
| 4 of a kind + 3 cards | 4 of a kind + lowest other card | 2 highest cards |
| Full House + 2 cards | Full House | 2 cards |
| 7 card Flush | 5 lowest cards | 2 highest cards |
| 6 card Flush + 1 card | 5 lowest Flush | highest flush card + 1 card |
| Flush + 2 cards | Flush | other cards |
| 7 card Straight | 5 lowest | 2 highest |

TABLE 5-continued

| 7- card holding | High hand | Low hand |
|---|---|---|
| 6 card Straight + 1 card | 5 lowest Straight | highest Straight card + 1 card |
| 5 card Straight + 2 cards | Straight | 2 cards |
| 3 of a kind + 4 cards | 3 of a kind + two lowest | 2 highest |
| 3 pair + 1 card | lowest 2 pair + 1 card | highest pair |
| 2 pair + 3 cards | 2 pair + lowest | 2 highest |
| one pair + 5 cards | pair + 3 lowest | 2 highest |
| Highest Order | highest + 4 lowest | next highest + 1 |

SF refers to a Straight Flush.

Of course it is to be understood that the processor can be programmed to assemble the dealer's hands to effectuate the best strategy.

The assembled cards of the dealer's hand are displayed at display 30 in the order of highest ranking as was the player's hand 50. The processor upon arranging and displaying of the dealer's hand at 64 compares the player's arranged hand 50 to make sure that it complies with the rules of pai gow poker, i.e. that the high hand outranks, according to the rules of Poker, the player's arranged low hand. If it is deemed at 64 that the player has misarranged his/her hand, that is deemed an automatic loss for the player and the wager as shown at 66 is forfeited. The player's hands 50 are then compared at 67 to a progressive jackpot combination also stored in the second data structure 58, described below, to determine whether or not the player qualifies for progressive jackpot. If indeed the player does qualify, the processor issues a signal resulting in payment of the jackpot to the player as shown at 68.

If the player does not qualify for the progressive jackpot, the processor compares at 70 the arranged player's hand 50 to the dealer's hand 48 to determine whether or not the player has won the hand. If the player's high and low hands outrank the dealer's high and low hands that is deemed a player win and the player is paid according to a pay table as shown at 71. If the player has a qualifying bonus hand in comparison to the qualifying combinations stored in the first data structure 46, the player is paid according to the pay tables recited above.

If the player's hand 50 does not beat the dealer's hand 48 or the hand is not a push, that is deemed to be a loss for the player and the processor deems the hand a player loss as shown at 72. If the hand is deemed a player's loss at 72, the processor compares the player's high hand to the qualifying bad beat combinations recited in Tables 2 or 4 to determine if a qualifying bad beat combination has been obtained. If a bad beat combination has been obtained by the player as at 74 the player is paid at 76 according to the bad beat combination tables as shown in the preferred embodiment in Tables 2 or 4. If there is no bad beat combination, the player's wager is forfeited at 80.

If the resolution at 70 and 72 is neither a win or a loss the processor at 78 determines whether the hands are a push. The rules for determining whether or not the player has won or lost the hand is determined as above. The rules regarding a "push" hand are also the same. That is, preferably, for the player to obtain a push the player's high hand must have jacks or better and outrank the dealer's high hand.

After the hands are resolved as above, the player makes a new wager to play a new hand and initiates play.

As can be appreciated, the device 26 as described above provides an exciting video version of the game according to the present invention. The player is paid if they are fortunate enough to obtain one of the predetermined qualifying combinations or bad beat combinations according to a pay table. This increases the excitement of the game in that the player may strive to obtain greater payoffs. Furthermore, since the game according to the present invention as incorporated into the device 26 requires a qualifying holding to obtain a push, commissions are not assessed for playing the game and the payoffs can be provided. Furthermore, there is a bad beat combination feature which enables the player to obtain a payoff even though the dealer has defeated the player's hand.

With reference to FIG. 4 yet a further feature of the present invention is shown. Like components have like reference numerals.

According to this embodiment, several of the devices 26 are interconnected by suitable communication links to a master controller 82. The master controller 82 polls the processor of each device 26 and based upon the wagers received thereat, allocates a portion of each wager to assemble a progressive jackpot. The links between the devices 26 may be within a particular casino or may be linked throughout different casinos. It is to be understood that the greater the number of the devices 26 interconnected with the master controller 82 the faster the progressive jackpot will grow. The master controller 82 in turn is linked to progressive jackpot display 84 which may be included with the displays 30 of each device 26 or may be on a separate display associated with each device 26. The progressive jackpot displays 84 display the current amount of the progressive jackpot.

To be awarded the progressive jackpot, the player must obtain a qualifying progressive jackpot holding of the player's hand 50. Preferably, this progressive jackpot holding is a Royal Flush for the player's high hand and a pair of Aces for the player's low hand. It is to be understood that any other progressive jackpot combination can be used to award the progressive jackpot such as a Royal Flush and a pair of Kings, a Royal Flush with a low hand of the nine and eight of the same suit as the Royal Flush or the like. Further it is to be understood that lesser progressive jackpots can also be provided for other qualifying combinations. For example, a secondary progressive jackpot can also be assembled by the master controller 82 and displayed at each of the progressive jackpot displays 84. If the player obtains a predetermined secondary progressive jackpot holding, the player would be awarded the secondary progressive jackpot. As but an example, the secondary progressive jackpot may be a seven card Straight Flush or the like.

While we have shown and described certain embodiments to the present invention it is to be understood that it is subject to many modifications and changes not departing from the spirit and scope of the claims presented herein. For example, where the device display 30 incorporates a touch screen feature the selection buttons may be incorporated into the touch screen display or the selection of cards for the player's hands could be made by the player touching the selected cards. Further, rather than selecting cards for the low hand, the player could select cards for the high hand with the remainder of the cards assigned to the low hand. Still further, other payouts could be used to adjust the advantage to the casino.

We claim:

1. A method for playing an improved game of Pai Gow poker played by a dealer and a player comprising:

the player making a wager;

dealing seven cards to the dealer and seven cards to the player;

the player assembling a five card high hand and a two card low hand, said high hand having a ranking according to the ranking of hands of Poker greater than the low hand;

the dealer forming a five card high hand and a two card low hand, said high hand having a ranking according to the ranking of hands of Poker greater than the low hand;

exposing and resolving the player's hands in comparison to the dealer's hands to determine the outcome, (i) the player declared a winner if his high and low hands outrank the corresponding dealer high and low hands according to the ranking of hands of Poker, (ii) the hands declared a push if the player's high hand outranks the dealer's high hand and has at least a holding having a Poker ranking of at least a pair and the dealer's low hand outranks the player's low hand, (iii) all other outcomes declared a loss for the player; collecting the player's wager for a player losing outcome and for a player winning outcome;

(i) determining whether the player's high hand corresponds to a holding of a predetermined schedule of designated Poker rankings and if so, playing the player greater than 1:1 based upon the wager, and (ii) otherwise paying the player 1:1 based upon the wager.

2. The method of claim 1 including declaring the hands a push if the player's high hand outranks the dealer's high hand and constitutes a holding of having a Poker ranking of a pair of Jacks or better and the dealer's low hand outranks the player's low hand.

3. The method of claim 1 including designating the predetermined schedule of designated holdings as a Royal Flush, a Straight Flush, Four of a Kind, a Full House, a Flush, a Straight, Three of a Kind, Two Pair or a Pair.

4. The method of claim 3 including paying the player for a designated holding according to the following,

| | |
|---|---|
| Royal Flush | 800 to 1 |
| Straight Flush | 200 to 1 |
| Four of a kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1. |

5. The method of claim 1 further including allocating a portion of each wager to a progressive win jackpot and paying the progressive win jackpot to a player if the outcome is a player win and the player's has a jackpot holding.

6. The method of claim 5 including paying the progressive win jackpot to the player when the player's has a jackpot holding of a high hand Royal Flush and the low hand is a pair of Aces.

7. The method of claim 1 including dealing the cards from a standard fifty-two card deck plus a Joker, said Joker designated as wild to represent an Ace or a card in a Straight Flush, Flush or Straight.

8. The method of claim 7 including paying the player having a designated holding according to the following

| | |
|---|---|
| Five Aces | 800 to 1 |
| Royal Flush | 800 to 1 |
| Straight Flush | 200 to 1 |
| Four of a Kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1. |

9. The method of claim 1 including designating at least one predetermined holding of the player's high hand as a bad beat combination, for player losing outcomes comparing the player's high hand to said bad beat holding and if said high hand corresponds to said bad beat holding paying the player.

10. The method of claim 9 including designating a selected one of a Royal Flush, Straight Flush or Four of a Kind as the bad beat holding.

11. The method of claim 10 including designating the following holdings as bad beat holding as and providing the corresponding payoffs

| | |
|---|---|
| ROYAL FLUSH | 400 to 1 |
| STRAIGHT FLUSH | 100 to 1 |
| FOUR OF A KIND | 10 to 1. |

12. An electronic gaming machine for playing a game of Pai Gow Poker comprising:

a processor including a first data structure representing each card of a standard deck of fifty-two cards and a second data structure of qualifying, Poker ranking, card holdings;

means for randomly selecting from the first data structure seven dealer cards and seven player cards;

a display to display said selected dealer and player cards;

means for accepting a wager from the player to play a game;

means for initiating play of a game, initiation of play signaling the processor to select and display said dealer cards face down and said player cards face up;

means for the player to select from the player cards two cards for a player low hand and five cards forming a player high hand, said high hand having a higher ranking than the low hand according to the ranking of hands of Poker;

said processor programmed to arrange the dealers cards into a dealer low hand and a dealer high hand and to display the hands face up, said high hand having a higher ranking according to the ranking of hands of Poker;

said processor programmed to compare the dealer and player low and high hands to determine if the player has obtained a winning, losing or push outcome determined by, (i) if the player's high and low hands outrank according to the ranking of hands of Poker the corresponding dealer high and low hands, the outcome is determined to be a winning outcome, (ii) if the player's high hand outranks the dealer's high hand and has a predetermined qualifying Poker ranking holding of at least a pair and the dealer's low hand outranks the player's low hand, the outcome is determined to be a push, (iii) all other outcomes are determined to be losing outcomes;

said processor programmed, for winning outcomes, to compare the cards of the player's high hand to the qualifying holdings of the second data structure to determine if the player's high hand is a qualifying holding; and means for (i) returning the player wager for determined pushes, (ii) paying the player 1:1 based upon the wager for winning outcomes without a qualifying holding and (iii) paying the player for winning outcomes with a qualifying holding at odds greater than 1:1 based upon the wager and collecting the wager for losing outcomes.

13. The machine of claim 12 wherein second data structure includes data representing qualifying Poker combinations of Royal Flush, Straight Flush, Four of a Kind, Full House, Flush, Straight, Three of a Kind, Two Pair and Pair.

14. The machine of claim 12 wherein the paying means includes means for paying a player substantially as follows:

| | |
|---|---|
| Royal Flush | 800 to 1 |
| Straight Flush | 200 to 1 |
| Four of a Kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1. |

15. The machine of claim 12 including a housing, said display mounted on the housing and the player selecting means includes a button on the housing associated with each card of the player's card, actuation of the button by the player selecting the cards for the Player low hand, the remaining cards defining the high hand.

16. The machine of claim 12 said processor programmed to determine the Poker rankings of the player's high and low hands and if said player's low hand outranks the high hand, said processor for a determined incorrect selection determining the play to be a losing outcome.

17. The machine of claim 12 said processor programmed to determine from the players cards the appropriate high and low hands according to the ranking of hands of Poker and comparing the player's selected high and low hands to said appropriate hands to determine a correct or incorrect selection, said processor for a determined incorrect selection overriding the player's selection and selecting said determined appropriate hands as the player's high and low hands.

18. The machine of claim 12 wherein said processor includes in the second data structure data representing at least one predetermined bad beat Poker ranking holding and, for determined losing outcomes, said processor programmed to compare the player's high hand with the bad beat qualifying holding, said paying means paying when the player obtains said bad beat combination.

19. The machine of claim 18 wherein the bad beat combination is a player high hand selected from one of a Royal Flush, a Straight Flush or Four of a Kind.

20. The machine of claim 12 wherein said first data structure includes data representing a standard deck of fifty-two cards plus a Joker, said Joker representing an Ace or a card in a Straight Flush, Flush or Straight.

21. The machine of claim 20 wherein second data structure includes data representing qualifying Poker ranked holdings of at least one of Five Aces, Royal Flush, Straight Flush, Four of a Kind, Full House, Flush, Straight, Three of a Kind, Two Pair, and a Pair.

22. The machine of claim 20 wherein the paying means includes means for paying a player for qualifying Poker ranking holdings substantially as follows:

| | |
|---|---|
| Five Aces | 800 to 1 |
| Royal Flush | 800 to 1 |
| Straight Flush | 200 to 1 |
| Four of a Kind | 20 to 1 |
| Full House | 10 to 1 |
| Flush | 9 to 1 |
| Straight | 5 to 1 |
| Three of a Kind | 4 to 1 |
| Two Pair | 3 to 1 |
| Pair | 2 to 1. |

23. The machine of claim 12 wherein said processor includes in the second data structure data representing at least one predetermined bad beat qualifying combination and, for determined losing outcomes, said processor programmed to compare the player's high hand with the bad beat qualifying combination, said paying means paying if the player obtains said bad beat combination.

24. The machine of claim 23 wherein the bad beat combination is a player high hand selected from one of a five Aces, a Royal Flush, a Straight Flush or Four of a Kind.

25. The machine of claim 12 further including means for allocating a portion of each wager to a progressive jackpot, at least one of the combinations of the second data structure designated as a jackpot combination and said paying means paying the player said jackpot for winning outcomes and where the player's high hand corresponds to said jackpot combination.

26. A system for playing a game of Pai Gow Poker comprising:

a plurality of devices each including, (i) a processor including a first data structure representing each card of a standard deck of fifty-two cards and a second data structure of qualifying, Poker ranking, card combinations and a jackpot combination, (ii) means for randomly selecting from the first data structure seven dealer cards and seven player cards, (iii) a display to display said selected dealer and player cards, (iv) means for accepting a wager from the player to play a game and generating a signal indicative of the wager made, (v) means for initiating play of a game, initiation of play signaling the processor to select and display said dealer cards face down and said player cards face up, (vi) means for the player to select from the player cards two cards for a player low hand and five cards forming a player high hand, said high hand having a higher ranking than the low hand according to the ranking of hands of Poker.

(vii) said processor programmed to arrange the dealer's cards into a dealer low hand and a dealer high hand and to display the hands face up, said high hand having a higher ranking according to the ranking of hands of Poker, (viii) said processor programmed to compare the dealer and player low and high hands to determine if the player has obtained a winning, losing or push outcome determined by, (a) if the player's high and low hands outrank according to the ranking of hands of Poker the corresponding dealer high and low hands, the outcome is determined to be a winning outcome, (b) if the player's high hand outranks the dealer's high hand and has a predetermined qualifying Poker ranking of at least a pair and the dealer's low hand outranks the player's low hand, the outcome is determined to be a push, (c) all other outcomes are determined to be losing outcomes, (ix) said processor programmed, for winning outcomes, to compare the cards of the player's high hand to the qualifying combinations of the second data structure to determine if the player's high hand is a qualifying combination, (x) said processor generating a data signal indicative of the player's high and low hands, and (xii) means for (a) returning the player's wager for determined push hands, (b) for paying the player 1:1 based upon the wager for winning outcomes without a qualifying combination, (b) paying the player for winning outcomes with a qualifying combination greater than 1:1 based upon the player's wager and collecting the wager for losing outcomes;

a master controller;

means for electronically linking said devices to said controller for transmitting said wager and combination data signals to said controller;

said controller programmed to allocate a portion of each wager to assemble a progressive jackpot;

means for displaying the current amount of the jackpot; and said controller programmed to, in the event the player obtains said jackpot combination, issuing a signal to award the player said progressive jackpot.

* * * * *